US005083760A

United States Patent [19]

Yamazaki et al.

[11] Patent Number: 5,083,760

[45] Date of Patent: Jan. 28, 1992

[54] FINISHER FOR AN IMAGE FORMING APPARATUS

[75] Inventors: Hideo Yamazaki, Tokyo; Kazunori Kubota, Yokohama; Yuichi Fujii, Okazaki; Mituru Ichikawa, Nishio; Yukitaka Nakazato, Tokyo, all of Japan

[73] Assignee: Ricoh Company, Ltd., Tokyo, Japan

[21] Appl. No.: 505,452

[22] Filed: Apr. 6, 1990

[30] Foreign Application Priority Data

| | | | |
|---|---|---|---|
| Apr. 18, 1989 | [JP] | Japan | 1-45537[U] |
| Apr. 18, 1989 | [JP] | Japan | 1-98382 |
| Apr. 18, 1989 | [JP] | Japan | 1-98383 |
| Apr. 20, 1989 | [JP] | Japan | 1-101269 |
| Apr. 20, 1989 | [JP] | Japan | 1-101270 |

[51] Int. Cl.[5] ..... B42B 1/02

[52] U.S. Cl. ..... 270/53; 270/58

[58] Field of Search ..... 270/37, 53, 58

[56] References Cited

U.S. PATENT DOCUMENTS

| | | | |
|---|---|---|---|
| 4,898,372 | 2/1990 | Hirabayshi | 270/53 |
| 4,917,366 | 4/1990 | Murakami | 270/53 |
| 4,946,154 | 8/1990 | Nakamura | 270/53 |

FOREIGN PATENT DOCUMENTS

| | | | |
|---|---|---|---|
| 127976 | 5/1988 | Japan | 270/53 |
| 127977 | 5/1988 | Japan | 270/53 |
| 64-973 | 3/1989 | Japan | 270/52 |

OTHER PUBLICATIONS

Fehst, Jr., "Copier Skew Reduction" *IBM Technical Disclosure Bulletin*, vol. 23, No. 6, p. 2217, Nov. 1980.

*Primary Examiner*—Edward K. Look
*Assistant Examiner*—Therese M. Newholm
*Attorney, Agent, or Firm*—Oblon, Spivak, McClelland, Maier & Neustadt

[57] ABSTRACT

A finisher for use with a copier, printer or similar image forming apparatus for stapling or otherwise finishing paper sheets sequentially driven out of the apparatus. A paper sheet is introduced in a stapling section of a stapling device by being switched back, while being accurately guided by a guide member having a sufficient length. The stapling device is movable, independently of jogger fences which position paper sheets, to a particular position which is optimal for the size of stacked paper sheets and the position in which they are used. When a staple error detector detects a stapling error, a discharge path in use is switched over to another path. When a stapled paper stack is discharged, it is deformed in a wave-like configuration in a direction perpendicular to an intended direction of transport to be provided with a certain degree of rigidity. This allows the stapled paper stack to be driven out stably, epecially without being loosened at the discharge side. A jam detector detects a failure in the discharge of paper sheets in a discharging device with accuracy. A stapled paper stack is directly driven out of the stapling device without the intermediary of an exclusive path.

8 Claims, 12 Drawing Sheets

SN2
102
108
125
126
107
110
103
124
M3
121
M2
109
106
I
118
120
117
122
M1
104
18
105
101
SN1
53
54
55
60
59
56
6,5
61
47
II
64
1a,1b
17
63
67
62
14
48
3
46
50
51
S
19
52

FINISHER FOR AN IMAGE FORMING APPARATUS

BACKGROUND OF THE INVENTION

The present invention relates to a finisher for use with a copier, printer or similar image forming apparatus and operable to staple or otherwise finish paper sheets which are sequentially driven out of the apparatus.

A finisher of the kind described is generally constructed such that paper sheets sequentially fed out of an image forming apparatus are stacked on a staple tray and then stapled, and the stapled paper stack is let fall onto a discharge tray disposed below the staple tray. This type of finisher is disclosed in Japanese Patent Laid-Open Publication (Kokai) Nos. 62-20046, 62-191375, 62-176246, 62-290669, 59-82263, and 63-101268 by way of example.

The prior art finisher described above has some problems left unsolved, as follows.

(1) The staple tray overlying the discharge tray interferes with the operator's access to the finished paper stack on the discharge tray. The operator cannot reach the finished paper stack without bending down, resulting in troublesome work.

(2) A stapler staples a paper stack at a predetermined position without exception. Especially, there is a fear that the actual stapling position differs from an expected position, depending on the image forming direction or writing direction on the paper sheets.

(3) A problem with a prior art finisher of the type discharging a stapled paper stack onto an overlying tray is that an extra paper transport path and, therefore, an extra space is needed because the tray is disposed above the stapled paper stack.

(4) When the stapled paper stack is directly discharged from the stapler in order to eliminate the extra paper discharge path, it is likely that the paper sheets are creased and/or the number of paper sheets of a stack which can be discharged is decreased.

(5) It is impossible to detect a stapling error and a jam of a stapled stack accurately and efficiently.

SUMMARY OF THE INVENTION

It is therefore an object of the present invention to provide a finisher for an image forming apparatus which with a miniature configuration promotes easy and efficient manipulations, i.e., frees the operator from the need for bending down.

It is another object of the present invention to provide a finisher for an image forming apparatus which staples a paper stack at an adequate position or positions of the latter.

It is another object of the present invention to provide a finisher for an image forming apparatus which allows a stack of a number of paper sheets to be directly discharged from a stapler to a tray, thereby eliminating the need for an extra paper discharge path.

It is another object of the present invention to provide a finisher for an image forming apparatus capable of feeding paper sheets to a stapler in a desirable manner.

It is another object of the present invention to provide a finisher for an image forming apparatus which detects a stapling error and a jam of a stapled stack accurately and efficiently and thereby promote prompt processing for recovery.

It is another object of the present invention to provide a generally improved finisher for an image forming apparatus.

A finisher for stapling paper sheets sequentially driven out of an image forming apparatus of the present invention comprises a frame, a first tray disposed in an upper portion of the frame, a stapling section located in a lower portion of the frame, an inlet for receiving a paper sheet driven out of the image forming apparatus, a first path extending from the inlet to the first tray, a second path extending from the inlet to the stapling section, a second tray disposed below the first tray, a discharging device directly connected to the second tray for discharging a stack of paper sheets having been stapled by the stapling section onto the second tray. The stapling section comprises a paper receiver and a stapling device for stapling paper sheets loaded on the paper receiver.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT

Figure 1:
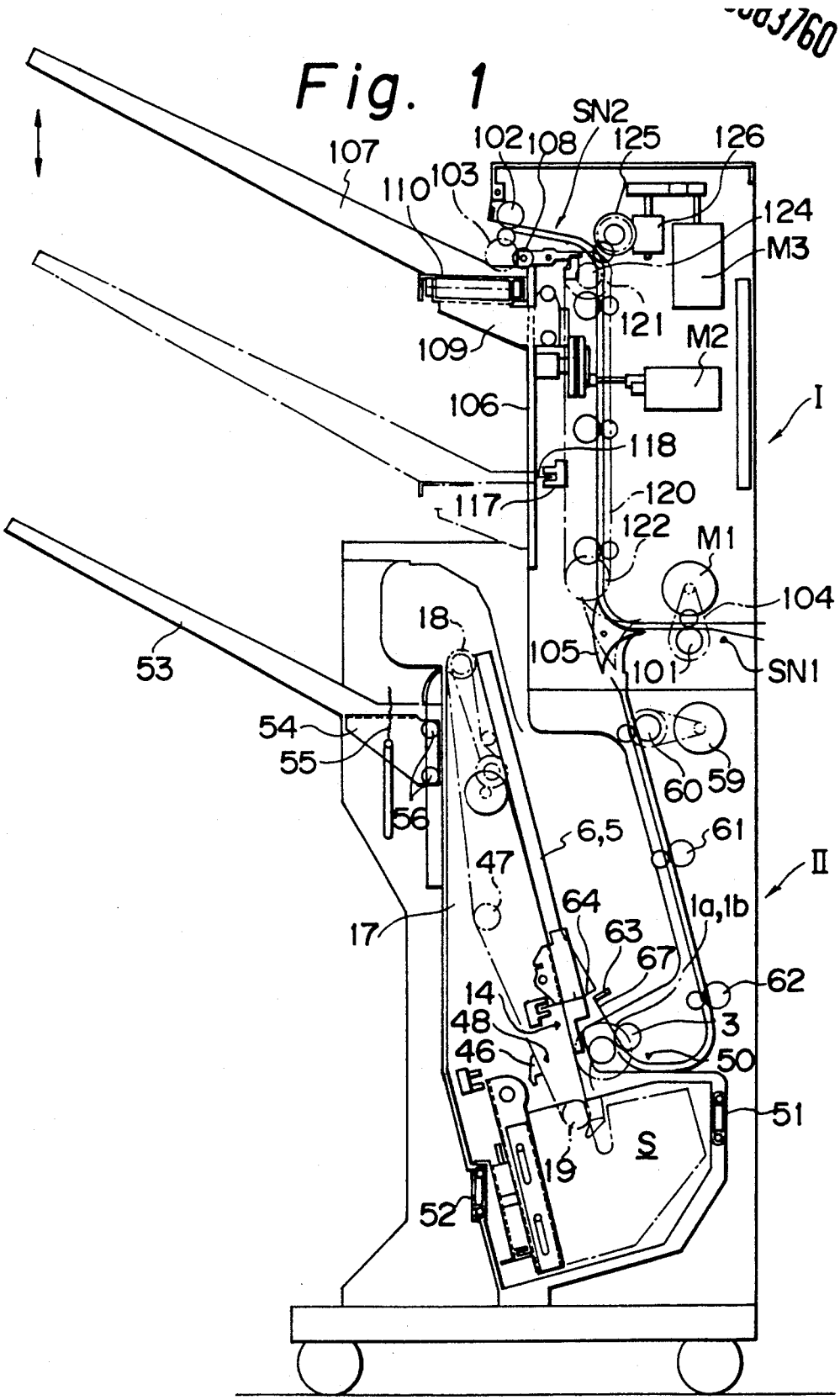
FIG. 1 is a side elevation showing the overall construction of a finisher embodying the present invention.

Referring to FIG. 1 of the drawings, a finisher embodying the present invention is shown which is operatively connected to one side of an image forming apparatus, not shown. As shown, the finisher is generally made up of a shiftable sorting section I and a stapling section II which is disposed below the sorting section 1.

The shiftable sorting section I has a paper transport path along which a plurality of transport rollers and driven rollers associated therewith are arranged. Specifically, a first transport roller 101 is mounted on a shaft which is in driven connection with the output shaft of a transport drive motor M1 through a first timing belt 104. The shaft of the roller 101 is in turn drivably connected by a second timing belt, not shown, to the shafts of the other transport rollers, the shaft of a discharge roller 102, and the shaft of a fur brush 103 which is adapted to position a paper sheet.

Paper sensors SN1 and SN2 immediately preceds the transport roller 101 and the discharge roller 102, respectively. The paper sensors SN1 and SN2 are each responsive to the leading and trailing edges of a paper sheet being transported. A guide pawl 105 is positioned downstream of the transport roller 101 and operated by a solenoid 230 (FIG. 9) and a spring, not shown, to select either one of a transport path extending to the stapling section II and a transport path extending to the sorting section I.

Figure 2:
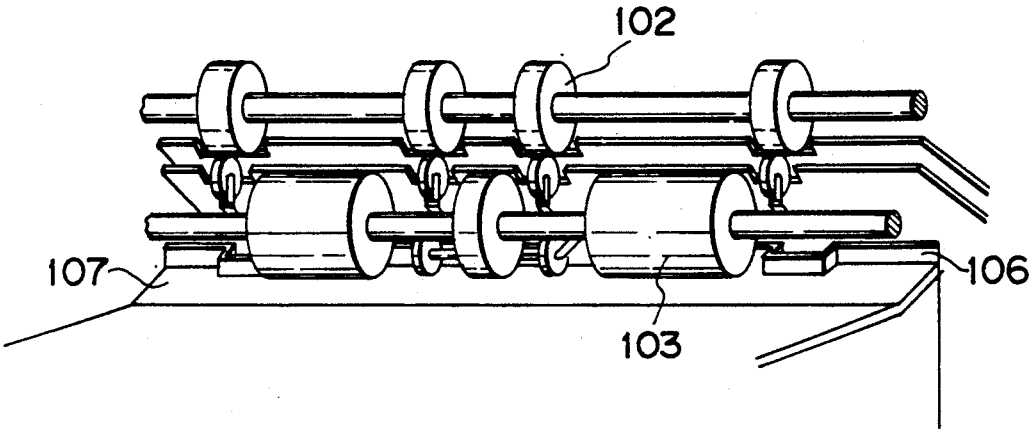
FIG. 2 is a perspective view of a paper discharging section associated with an upper tray.
Figure 3:
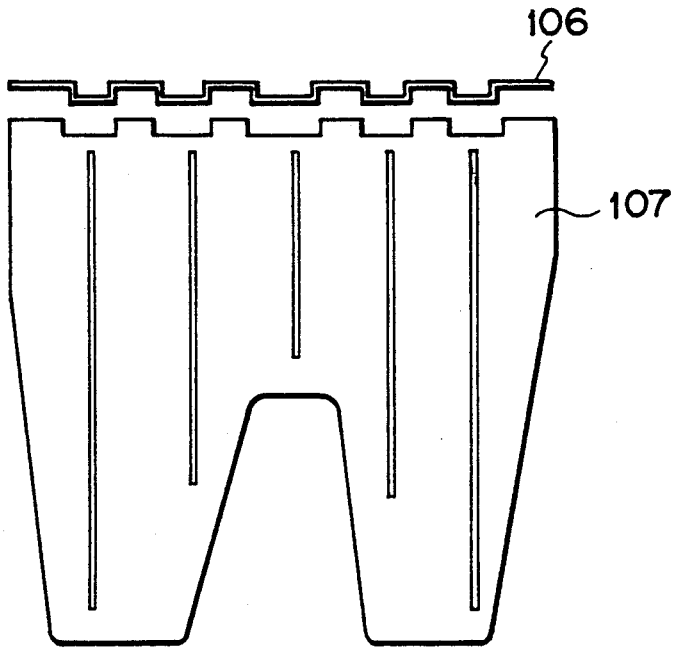
FIG. 3 is a plan view showing the upper tray and a stop plate which is engaged with the upper tray and included in a tray shifting mechanism.
Figure 4:
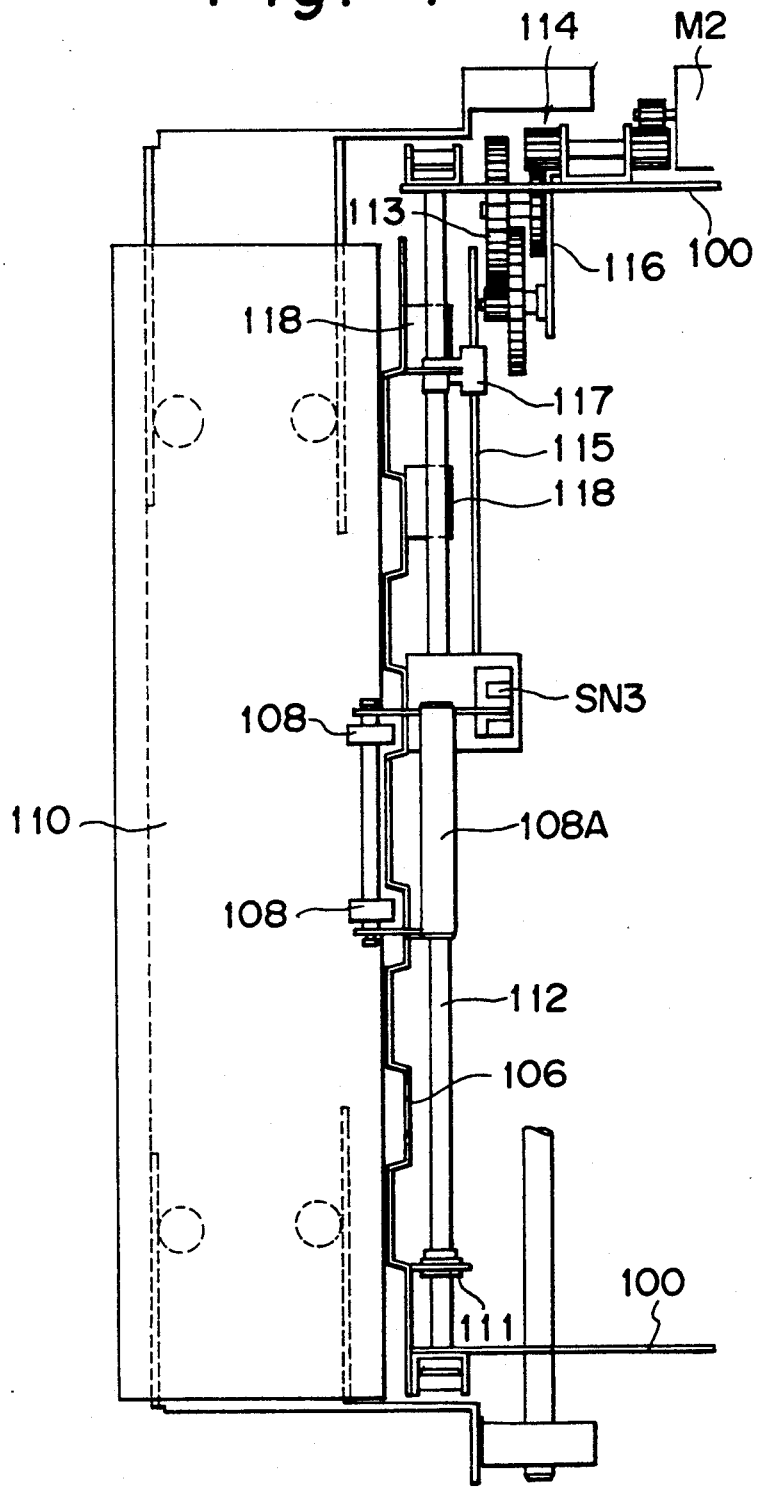
FIGS. 4 and 5 are respectively a plan view and a perspective view each showing a drive line included in the tray shifting mechanism.

As shown in FIGS. 2, 3 and 4, the fur brush 103 is disposed just below the discharge roller 102 in the vicinity of a paper outlet. A paper sheet dropped onto an upper tray or discharge tray 107 is shifted by the fur brush 103 into abutment against a stop plate 106, so that its leading edge is regulated in position.

Figure 5:
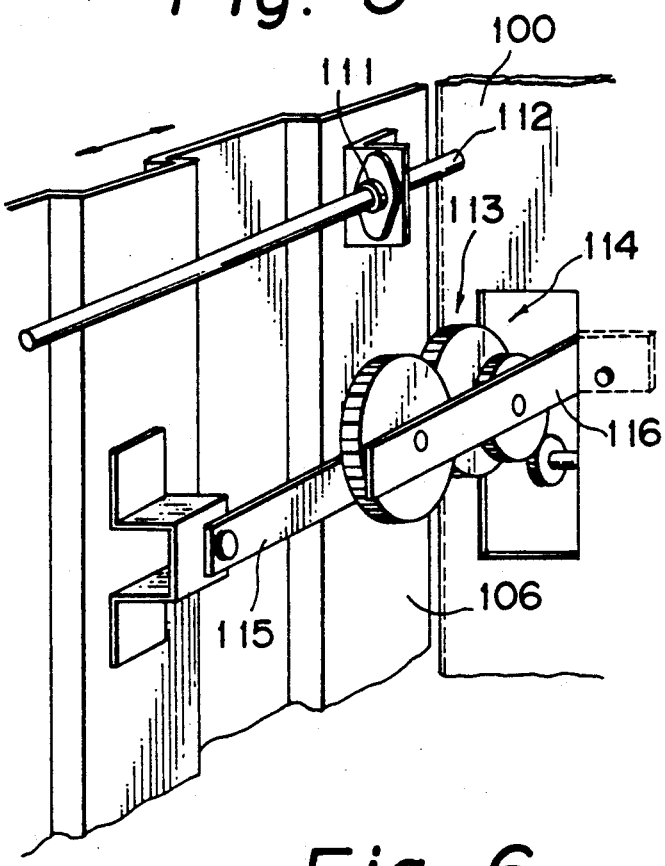

As FIG. 3 indicates, the stop plate 106 and upper tray 107 are provided with projections and recesses which mate with each other. In this configuration, the tray 107 is freely movable up and down (direction perpendicular to the sheet surface of FIG. 3) relative to the stop plate 106 and movable backward and forward (left-and-right direction in FIG. 3) interlocked with the stop plate 106. As shown in FIGS. 4 and 5, the stop plate 106 is mounted on a rod or shift guide 112 through a bearing 111 at the side adjacent to the image forming apparatus and, therefore, free to move backward and forward. As also shown in FIG. 5, the stop plate 106 is connected to a crank 113 by an arm rod 115 in an eccentric position. The crank 113 has an axis of rotation which extends parallel to the center axis of the image forming apparatus, e.g. a copier. A bracket 116 is removably mounted on a side wall 100 and extends perpendicularly from the latter. A gear train 114 is mounted on the bracket 116 to operatively connect the crank 113 to a shift motor M2. The shift motor M2 drives the crank 113 so that the stop plate 106 is caused into a reciprocating motion due to the eccentric rotation of the crank 113. Then, the stop plate 106 moves the discharge tray 107 backward and forward, as stated earlier. A shift sensing plates 118 protrude from the stop plate 106 and are spaced apart from each other by a distance which is substantially the same as the displacement defined by the crank 113. A shift sensor 117 is located to face the stop plate 106 so as to detect the end of an iterative operation consisting of the abutment of a paper sheet and the shift of the tray 107.

Figure 6:
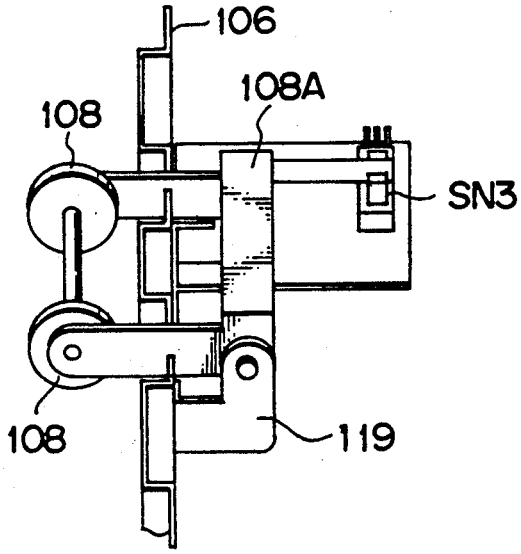
FIG. 6 is a perspective view of a paper pressing mechanism.

As also shown in FIG. 6, a bracket 119 is rigidly mounted on the stop plate 106. Presser rollers 108 are supported by the bracket 119 in such a manner as to be rotatable and movable up and down, thereby constantly pressing itself against the top of a paper stack by gravity. Specifically, a paper sheet is caused to get under the presser rollers 108 by gravity and the force of the fur brush 103 until it abuts against the stop plate 106. When the upper tray 107 is shifted as stated earlier, the presser rollers 108 serve to prevent paper sheet from being dislocated. A paper surface sensor SN3 is mounted on the finisher body to face the presser rollers. When the presser rollers 108 are raised by paper sheets which are sequentially tacked on the tray 107, the paper surface sensor SN3 senses a part of a roller support bracket 108A and thereby determines that the top of the paper stack or the upper surface of the discharge tray 107 has reached a predetermined height.

Figure 7:
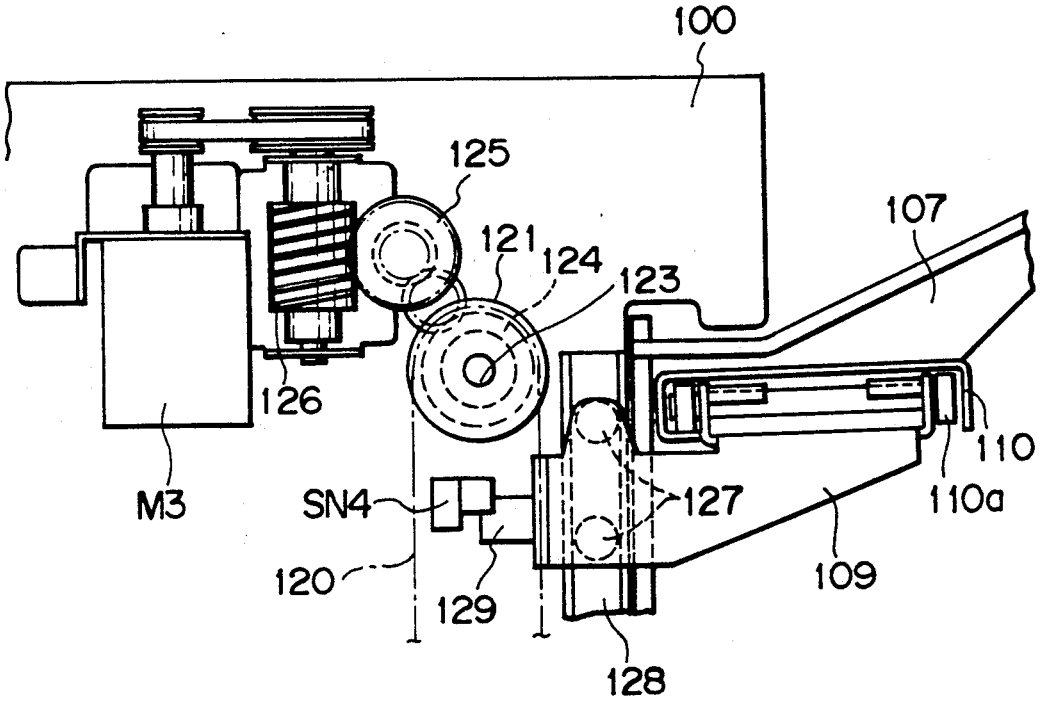
FIGS. 7 and 8 are respectively a side elevation and a perspective view of a mechanism for moving the upper tray up and down.
Figure 8:
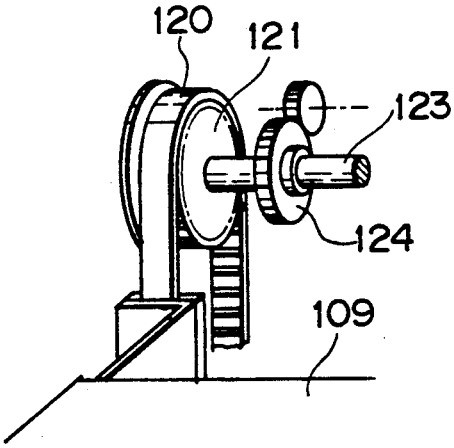

Referring to FIGS. 7 and 8, an elevating mechanism includes a tray support 110 on which the upper tray 107 is rigidly mounted. The tray support 110 is in turn loaded on a tray mounted 109 through bearings 110*a* in such a manner as to be movable back and forth thereon. This allows the tray 107 to be shifted in the previously described manner by the stop plate 106 on the tray mount 109. The tray mount 109 is affixed to a third timing belt 120, as also shown in FIG. 1. The third timing belt 120 is located at the outside of each of the front and rear side panels 100. Each timing belt 120 is passed over a drive pulley 121 and a driven pulley 122. The two drive pulleys 121 are securely mounted on a drive shaft 123 which extends throughout the opposite side panels 100. A gear 124 is mounted on the drive shaft 123 and has a one-way clutch thereinside. The one-way clutch is so constructed as to transmit a force acting in a direction for elevating the discharge tray 107 to the drive shaft 123. The gear 124 is connected to an elevation motor M3 by a gear train, a worm wheel 125, and a worm 126. Bearings 127 are mounted on the the sides of the tray mount 109 which face the side panels 100, while guide rails 128 are mounted on the side panels 100. The bearings 127 and guide rails 128 are mated together to guide the up-and-down movement of the tray mount 109 while preventing the tray 107 from falling due to the moment of rotation ascribable to gravity.

In the above-described mechanism, the upper tray 107 is usually prevented from moving downward due to the retaining force of the worm 126 and the locked state of the one-way clutch. When the elevation motor M3 is driven in a direction for elevating the tray 107, the one-way clutch is locked to rotate the pulleys 121 and 122 with the result that the tray 107 is elevated. When the motor M3 is rotated in the other direction, i.e., in a direction for lowering the tray 107, the one-way clutch is unlocked to allow the tray 107 to move downward due to gravity.

Figure 9:
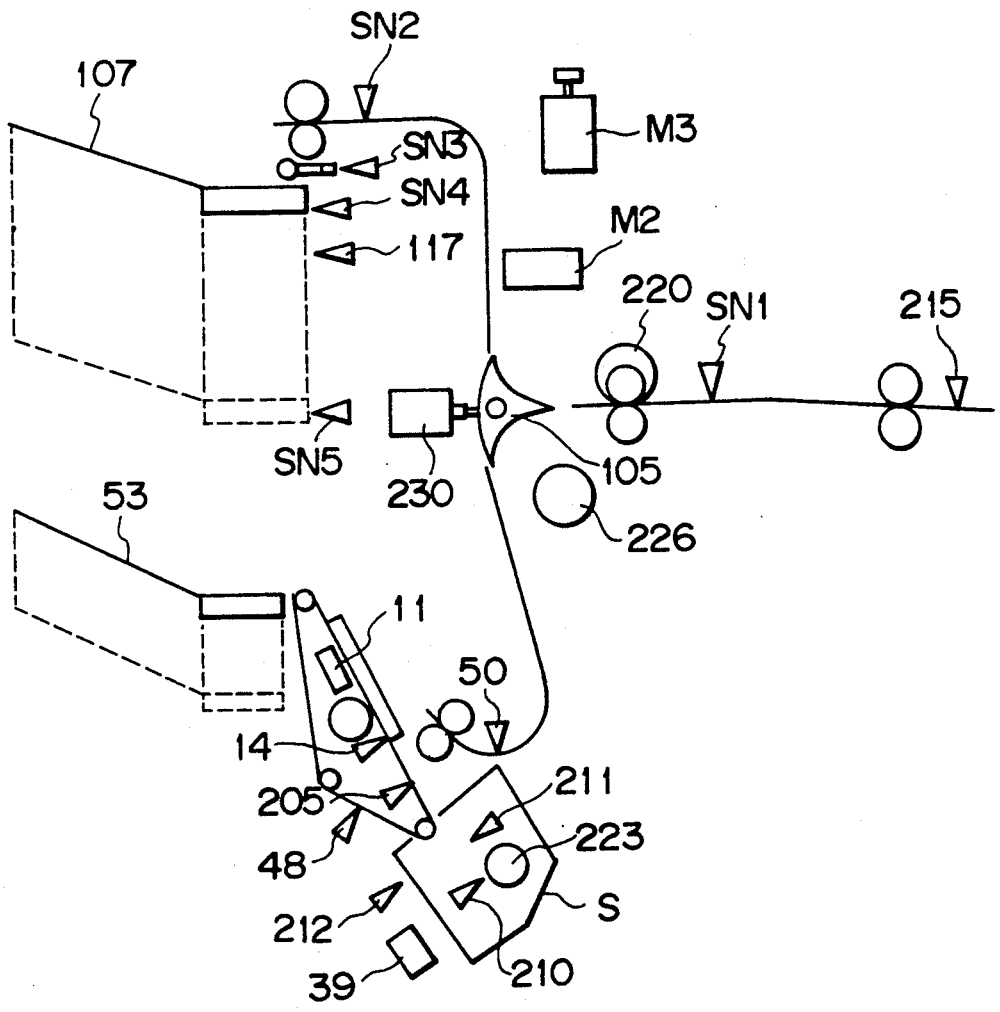
FIG. 9 is a schematic side elevation representative of a paper discharging arrangement.

As also shown in FIG. 9, an upper limit sensor SN4 and a lower limit sensor SN5 are disposed inward of the timing belts 120 and to face the tray 107. The sensors SN4 and SN5 sense respectively the upper limit position and the lower limit position of the tray 107 in cooperation with an elevation sensin plate 129. While the tray 107 is in a downward movement, the one-way clutch is unlocked and, therefore, the rotation of the elevation motor M3 is not transmitted to the tray 107. Hence, even when the tray 107 is held in a halt by an externally derived force during the downward movement, the motor M3 simply idles and is, therefore, free from overloads while preventing, for example, the operator's fingers from being caught.

When a copying operation begins, the shift motor M2 is driven to rotate the crank 113. In turn, the crank 113 moves the stop plate 106 in the back-and-forth direction via the rod 115. The stop plate 106 in turn begins to shift the tray 107 in the same direction. As soon as the shift sensor 117 senses one of the shift sensing plates 118 which is different from the other which it has sensed before the start of the shifting operation, the shift motor M2 is deenergized to end the shifting operation. Thereupon, the elevation motor M3 is driven in the direction for elevating the discharge tray 107. As the paper surface sensor SN3 senses a part of the bracket 108A which supports the presser rollers 108, the elevation motor M3 is deenergized to stop the elevation of the tray 107.

The feed roller 101 receives a paper sheet having been driven out of the copier at the same linear speed as the discharge speed of the copier. As the first paper sensor SN1 senses the trailing edge of the paper sheet, the linear speed is switched to a higher speed which is higher than the discharge speed of the copier. On the lapse of a predetermined period of time after the second paper sensor SN2 has sensed the leading edge of the paper sheet, the linear speed is switched over to the original or lower speed. Then, the paper sheet is driven out onto the tray 107. The paper sheet gets under the presser rollers 108 due to gravity and the force of the rotating fur brush 103 until it abuts against the stop plate 106, whereby the trailing edge of the paper sheet is regulated in position.

When more than a predetermined number of paper sheets, or copies, are stacked on the tray 107, the shift motor M2 is driven to start shifting the tray 107. On completing a single shifting operation, the shift motor M2 is deenergized. As a result, the position of the paper stack on the tray 107 is changed and thereby sorted on the tray 107. When a copy produced by the last one of a sequence of copying cycles is discharged onto the tray 107, the elevation motor M3 is rotated in the direction for lowering the tray 107. The tray 107 is brought to a stop when moved downward over a predetermined distance.

More specifically, assume that a predetermined number of paper sheets have been stacked on the upper tray 107 with the top of the stack being positioned near the paper outlet. Then, the paper sensor SN3 senses a part of the bracket 108A to drive the elevation motor M3 in the direction for lowering the tray 107. This cancels the retaining force of the worm 126 and unlocks the one-way clutch, causing the tray 107 to move downward by gravity. As the top of the paper stack on the tray 107 is lowered to such a level that the paper sensor SN3 does not sense the bracket 108A any longer, the elevation motor M3 is deenergized. Then, the one-way clutch is locked to stop the movement of the tray 107 in cooperation with the worm 126. When the tray 107 is lowered until the lower limit sensor SN5 senses the elevation sensing plate 129, the motor M3 is deenergized to prevent the tray 107 from being lowered any further.

Referring to FIGS. 1, 10, 11 and 12, a mechanism for moving a stapler S included in the stapling section II will be described. The stapler S is rigidly mounted on a stapler mount 31. A guide pin 32 extends out from the stapler mount 31 and is received in a guide slot **30*b* which is formed through a stapler slider 30. In this configuration, the stapler mount 31 is movable in a direction indicated by an arrow l in FIG. 2. A shaft 44 is mounted on the back of the stapler mount 31, while a guide roller 34 is rotatably mounted on the shaft 44. A guide rod 36 is supported at opposite ends thereof by side plates 41 and 42. The stapler slider 30 is mounted at an upper portion thereof on the guide rod 36 and slidable along the latter in a direction perpendicular to the sheet surface of FIG. 12. A guide roller 33 is provided on a lower portion of the stapler slider 30 and rolls on the surface of a stay 43 which is mounted on the finisher body, thereby restricting the stapler slider 30 with respect to the angular movement. A guide cam 35 is affixed to the stay 43 and provided with a cam surface at the upper end thereof. The guide roller 34 rollably rests on the cam surface of the guide cam 35. In this configuration, the stapler slider 30 is movable in a reciprocating motion as indicated by an arrow k in FIG. 10. The intermediate portion of the guide cam 35 is recessed downward so as to cam the stapler slider 30**.

Figure 10:
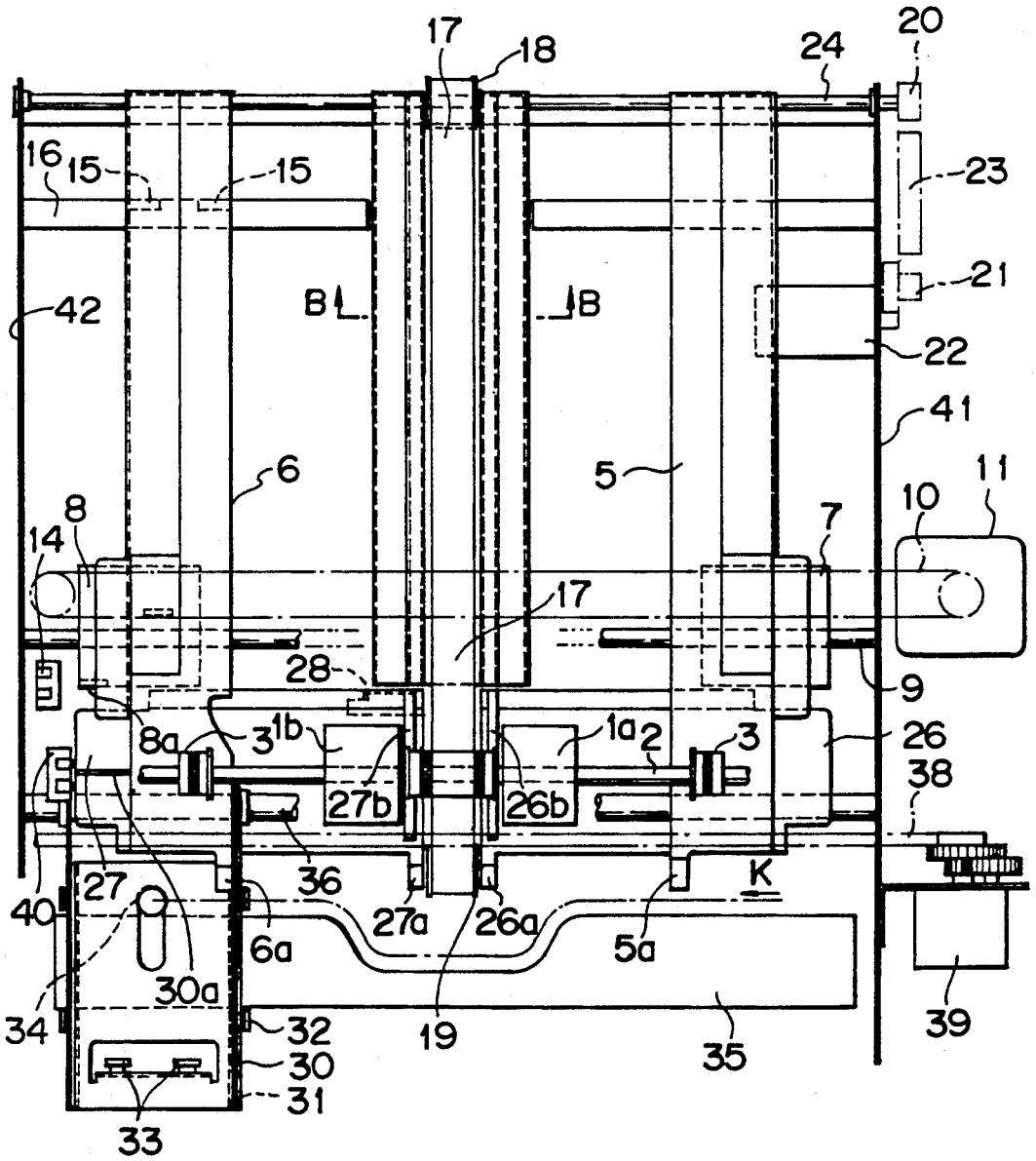
FIGS. 10 and 11 are respectively a front view and a bottom view of a stapling section.
Figure 11:
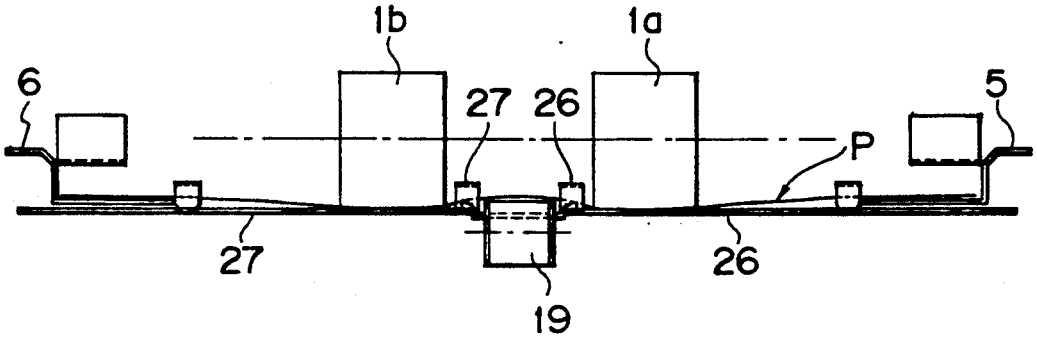
Figure 12:
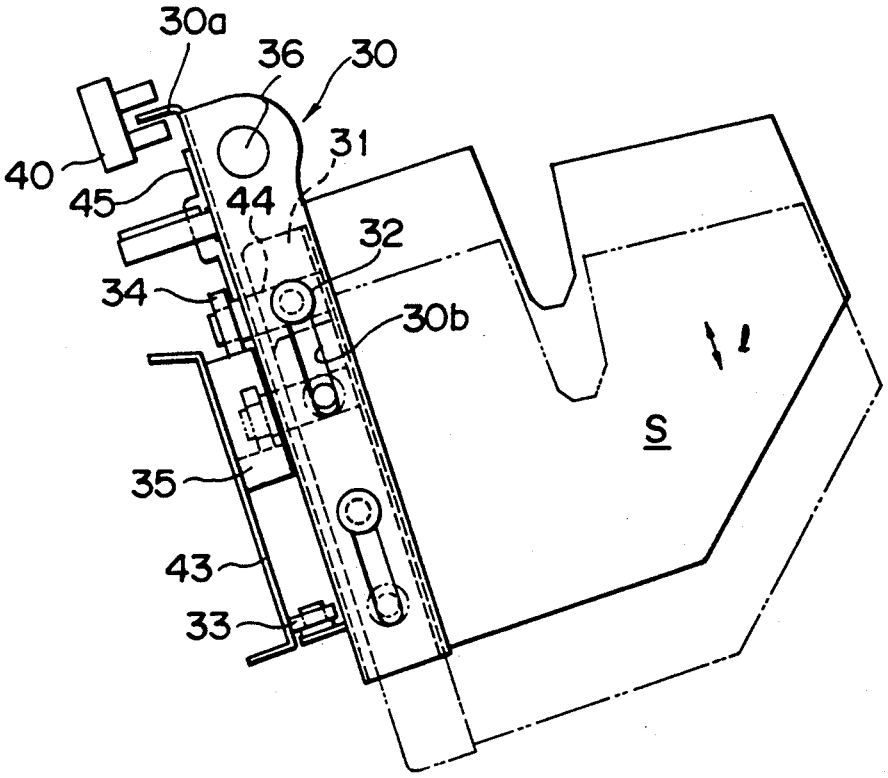
FIG. 12 is a side elevation representative of a structure for mounting a stapler.

A sensing plate **30*a* is mounted on the upper end of the stapler slider 30, while a home position sensor 40 having a sensing section is mounted on the finisher body. When the sensing plate 30*a* blocks the sensing section of the home sensor 40, the home position (HP) of the stapler S is sensed. A stepping motor 39 for moving the stapler S is mounted on the side wall 41, as shown in FIG. 10. The motor 39 drives a belt 38 to which the stapler slider 30 is affixed. Hence, the belt 38 drives the stapler slider 30 in the right-and-left direction of FIG. 10 by way of the belt 38**.

Figure 13:
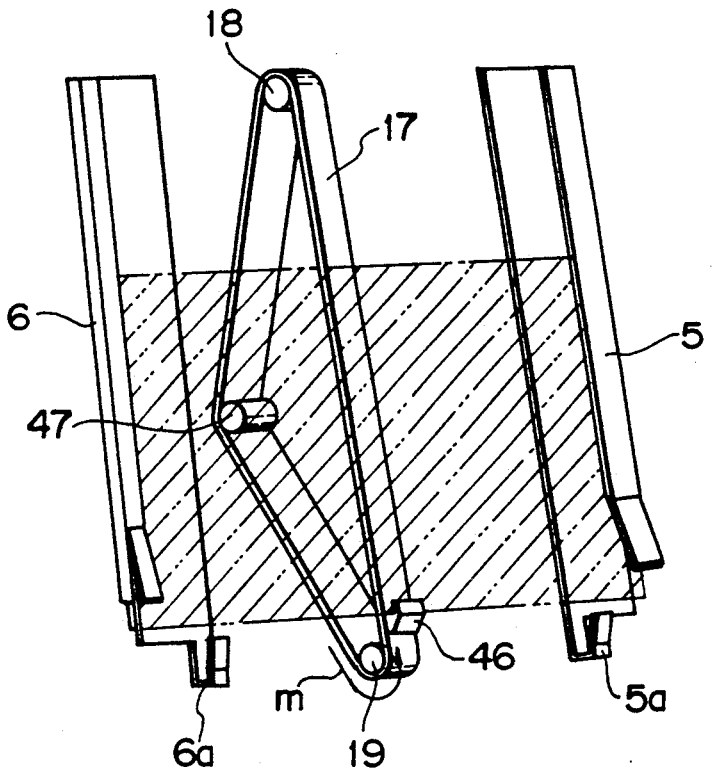
FIG. 13 is a perspective view of a discharging device associated with a lower tray.

A mechanism for moving jogger fences will be described with reference to FIGS. 10 and 13. As shown, the mechanism includes a jogger fence rod 9 extending between the opposite side walls 41 and 42. A right slider 7 and a left slider 8 are mounted on the jogger fence rod 9 to be movable in a reciprocating motion therealong. A right jogger fence 5 and a left jogger fence 6 are rigidly mounted on the right and left sliders 7 an 8, respectively. The jogger fences 5 and 6 function to neatly arrange a stack of paper sheets in the event of a stapling operation. Also, the jogger fences 5 and 6 extend from the vicinity of discharge rollers 3 to the vicinity of a lower tray or discharge tray 53 so as to play the role of guide members for guiding a stapled paper stack. The jogger fences 5 and 6 are respectively provided with rear end fences **5*a* and 6*a*** for sustaining the lower end of a stapled paper stack.

Figure 15:
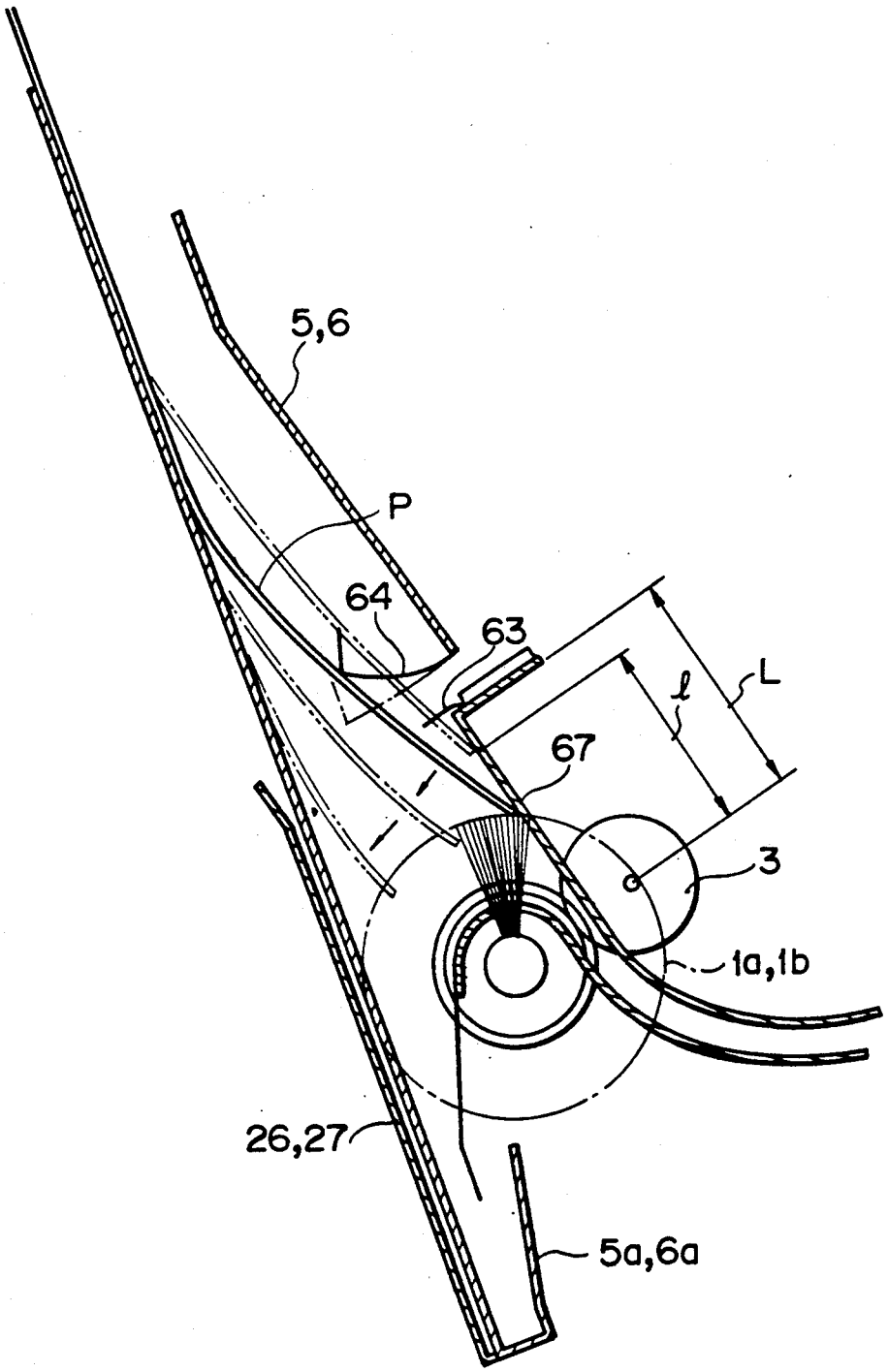
FIG. 15 is an elarged side elevation of a stapling and discharging section associated with the lower tray.

The right and left sliders 7 and 8 are affixed to a belt 10 which is driven by a jogger fence motor 11. More specifically, each of the sliders 7 and 8 is affixed to a different run of the belt 10 so that their associated jogger fences 5 and 6 may move in a reciprocating motion toward and away from each other in the right-and-left direction as viewed in FIG. 10. Guide rollers 15 are provided on the back of an upper portion of each of the jogger fences 5 and 6. The guide rollers 15 roll on a guide stay 16 which extends between and in an upper portion of the side walls 41 and 42. A sensing plate **8*a* is mounted on the left slider 8. The home position (HP) of jogger fences 6 and 5 is sensed when the sensing plate 8*a* blocks a sensing section of a home position sensor which is mounted on the finisher body. As also shown in FIG. 15, a pressing member 64 is provided at the lower end of each of the jogger fences 5 and 6 for preventing a paper sheet P from curling on the staple tray. The pressing member 64** may be implemented by a resilient member in the form of a polyester film, for example.

Figure 14:
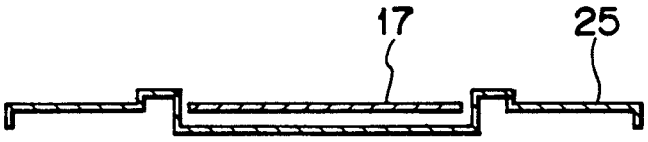
FIG. 14 is a section along line B—B of FIG. 13.

A discharge belt mechanism will be described with reference to FIGS. 10, 13 and 14. A drive shaft 24 is journalled to upper portions of the opposite side walls 41 and 42. A drive pulley 18 is mounted on the drive shaft 24 at substantially the intermediate between opposite ends of the latter. A pulley 19 is located below the drive pulley 18. An endless discharge belt 17 is passed over the pulleys 18 and 19 as well as over an idle pulley 47. A guide plate 25 is located inward of the belt 17 to free the latter from slackening and dislocation. A belt motor 22 is mounted on the side wall 41, while a pulley 21 is mounted on the output shaft of the motor 41. A belt 23 is passed over the pulley 21 and a pulley 20 which is mounted on one end of the drive shaft 24. A pawl 46 (FIGS. 1 and 13) protrudes from the surface of the belt 17 in order to sustain a paper stack, as will be described. As shown in FIG. 4, a home position sensor 48 is positioned between the opposite runs of the belt 17 for sensing the home position (HP) of the pawl 46. The belt 17 is movable at a speed $V_2$ which is equal to or slightly higher than the linear speed $V_1$ of the discharge rollers 3, so that a paper stack to be stapled next may be prevented from being discharged together with a stapled paper stack.

The various mechanisms of the stapler S described above are constructed into a single unit. Such a unit can be pulled out toward the operator along guide rails 51 and 52.

As shown in FIG. 1, a mechanism associated with the lower tray 53 includes a tray mount 54 on which the tray 53 is rigidly mounted. Guide rollers 56 are rotatably mounted on the tray mount 54 and engaged with a guide rail, not shown. The tray 53 is, therefore, movable up and down together with the tray mount 54. A lift spring 55 constantly biases the tray mount 54 upward.

A transport motor 59 is drivably connected to transport rollers 60, 61 and 62 by a belt, not shown. The transport motor 59 is also drivably connected to the discharge rollers 3 by a belt, not shown. Fur brushes 1*a* and 1*b* are mounted on the shaft 2 together with the discharge rollers 3 and are rotatable in synchronism with the rollers 3. The tips of the fur brushes 1*a* and 1*b* are held in contact with guide plates 26 and 27, respectively. The guide plates 26 and 27 have respectively ribs 26*b* and 27*b* for holding the lower end of a stapled paper stack. The guide plates 26 and 27 further have respectively ribs or projections 26*b* and 27*b* on their front faces. The ribs 26*b* and 27*b* and the fur brushes 1*a* and 1*b* cooperate to bend press a paper stack from opposite sides to thereby deform it backward in a wave-like configuration, whereby the paper stack is provided with a certain degree of rigidity.

As shown in FIG. 15, an outlet upper guide plate 67 protrudes beyond the center of rotation of the discharge rollers 3 by an amount L which is greater than an amount l over which an incoming paper sheet P protrudes. Therefore, even when the paper sheet S fails to drop below the fur brushes 1*a* and 1*b* and enters the gap between the upper guide plate 67 and the fur brushes 1*a* and 1*b*, the tips of the fur brushes 1*a* and 1*b* will successfully urge the trailing edge of the paper sheet P downward.

How the finisher handles incoming paper sheets will be described. Assume that the operator selects a staple mode by a staple key, loads a document table (RDH) with N documents, and operates numeral keys to enter a desired number K of volumes of copies. Thereafter, as the operator presses a copy start key, the copier body sends a copy size signal to the finisher. In response, the finisher determines whether or not the stapling section can accommodate paper sheets of the expected size. If the answer of the decision is positive, whether or not the pawl 46 of the discharge belt 17 is located at the home position is determined. If the stapling section cannot accommodate the particular size, the guide member 45 (FIG. 12) is maintained in an OFF state to steer incoming paper sheets toward the upper tray section. If the pawl 46 is not in the home position, the belt motor 22 is driven to return it to the home position. Whether or not the stapler S is in the home position is determined and, if the answer is positive, the stapler S is moved to a predetermined position by the size signal. If otherwise, the stapler S is moved until the home position has been sensed and then moved to the predetermined position by the size signal.

Whether or not the jogger fences 5 and 6 are held in their home position is determined and, if the answer is positive, they are moved to predetermined positions by the size signal. If otherwise, the jogger fences 5 and 6 are moved until the home position has been sensed and then moved to the predetermined positions by the size signal. Specifically, the jogger fences 5 and 6 will each be moved to a position which is $\alpha$ millimeters short of the size width, i.e. $2\alpha$ millimeters at opposite sides of the size width.

When the inlet sensor SN1 senses the leading edge of a paper sheet, the guide pawl 105 is switched over by the solenoid 230 to steer the paper sheet toward the staple tray. As soon as the leading edge of the paper sheet moves away from the inlet sensor SN1, the transport speed is switched to the higher speed. However, when the paper sheet is not fully driven out of the copier, the transport speed is maintained the same as the transport speed of the copier. The solenoid 230 is deenergized on the lapse of a predetermined period of time after the leading edge of the paper sheet has moved away from the inlet sensor SN1, i.e., when it moves away from the guide pawl 105. The discharge rollers 3 drive the paper sheet onto the staple tray. At this instant, a discharge brush 63 mounted on the upper guide plate 67 dissipates a charge from the paper sheet. The discharge rollers 3 have flanges to deform the paper sheet in a wave-like configuration and thereby provides the latter with a certain degree of rigidity. When the trailing edge of the paper sheet moves away from the rollers 3, the fur brushes 1*a* and 1*b* coaxial with the rollers 3 urge it upward. Consequently, the trailing edge of the paper sheet is caused into abutment against the rear end fences 26*a* and 27*a* and the rear end fences 5*a* and 6*a* extending from the jogger fences 5 and 6. On the lapse of a period of time which is sufficient for the trailing edge of the paper sheet to move away from the paper sensor 50, the motor 11 is rotated forward and then reversed once or twice to cause the jogger fences 5 and 6 to position the paper sheet in the widthwise direction. Thereafter, the jogger fences 5 and 6 are returned to their stand-by position. Such a positioning operation repetitively occurs for each paper sheet and continues until a signal representative of the end of one job, i.e., an end-of-job signal arrives from the copier body.

On the arrival of the end-of-job signal, the above-stated operation is executed again to cause the jogger fences 5 and 6 to hold the paper sheet therebetween. In this condition, a motor 223 (FIG. 9) installed in the stapler S is driven to staple the paper stack. In the event of stapling, whether the paper stack should be stapled at a single position or at two positions is determined. If the paper sheet should be stapled at one position thereof, the jogger fences 5 and 6 are individually shifted to positions which are slightly spaced apart from the paper stack, after the paper sheet has been stapled. If the paper sheet should be stapled at two positions, the stepping motor 39 moves the stapler to another predetermined position to staple the paper stack again and, then, the stapler is returned to the original position. Then, the discharge belt 17 is rotated as indicated by an arrow m in FIG. 13 to cause its pawl 46 to push the trailing edge of the stapled paper stack upward. As a result, the paper stack is discharged onto the lower tray 53 in the same direction as the direction in which the paper sheets have been fed onto the staple tray.

Subsequently, whether or not the desired K volumes have been fully stapled and discharged is determined. If the answer is positive, the stapler S is moved to its home position. If otherwise, the jogger fences 5 and 6 are shifted to certain positions in response to the size signal, and then the above-stated procedure is executed again.

Regarding the up-down movement of the upper tray 107, at the time of turn-on of power supply or at the time of mode selection, a CPU (Central Processing Unit) checks the upper limit sensor SN4, lower limit sensor SN5 and paper sensor SN3 to see their output states and thereby the current position of the tray tray 107. If the upper limit sensor SN4 and paper sensor SN3 have been turned on, the elevation motor M3 is energized to lower the tray 107 until the paper sensor SN3 turns off. When only the upper limit sensor SN4 has been turned on, no operation occurs. When all the upper limit sensor SN4, lower limit sensor SN5 and paper sensor SN3 have been turned off, the elevation motor M3 is energized to elevate the tray 107 until either the upper limit sensor SN4 or the paper sensor SN3 turns on; when the paper sensor SN3 turns on, the motor M3 is driven to lower the tray 107 until the paper sensor SN3 turns off. When only the paper sensor SN3 has been turned on, the elevation motor M3 is driven to lower the tray 107 until the paper sensor SN3 goes off. Further, when only the lower limit sensor SN5 has been turned on, the CPU determines that the tray 107 is full and sends a tray full signal to the copier body to urge the operator to remove the paper sheets from the tray 107. On reception of a clear signal from the copier body, the elevation motor M3 is energized to raise the tray 107 until either the upper limit sensor SN4 or the paper sensor SN3 turns off. On the turn-on of the paper sensor SN3, the tray 107 is lowered until it turns off.

When the operation is restarted in the same mode, the same sequence of steps as at the time of mode selection will be executed in response to a copy start signal from the copier body after the turn-on of power supply.

During the copying operation and at the end of the same, when the paper sensor SN3 turns on, the elevation motor M3 is energied to lower the upper tray 107 until the sensor SN3 turns off. Such a procedure is repeated until the lower limit sensor SN5 turns on. Then, a tray full signal is again transmitted to the copier body. When this kind of operation overlaps with the tray shifting operation stated earlier, the former will be performed later with priority given to the latter. When the last paper sheet moves away from a copier discharge sensor 215 (FIG. 9), the copier body sends a finisher stop signal to the finisher. In response, the elevation motor M3 is energized after the last paper sheet has been fed out onto the tray 107, whereby the tray 107 is lowered by a predetermined amount to facilitate the removal of the paper sheets.

Assume that the shifting operation is not executed at the time of the turn-on of power supply and, instead, a shift mode or a proof mode is selected at the time of mode selection. Then, in response to a mode signal, the shift motor M2 is energized to shift the discharge tray 107 and, on the turn-on of the shift sensor 117, deenergized. This is to sort a stack of paper sheets existing on the tray 107 and a stack of paper sheets which will be stacked by the next job. Such a sorting operation will be executed only after the up-down movement of the tray 107 is completed. More specifically, when the tray 107 is shifted as stated above, the presser rollers 108 press the paper sheets and thereby prevent them from being dislocated.

During the copying operation and at the end of the same, the copier body sends a shift signal to the finisher when the last paper sheet or copy moves away from the copier discharge sensor 215. In response, the finisher energizes the shift motor M2 on the lapse of a predetermined period of time after the last paper has moved away from the sensor SN2, thereby starting on a shifting operation. As the shift sensor 117 turns on, the shift motor M2 is deenergized. This operation has priority over the up-down movement of the tray 107 and thereby eliminates the dislocation of paper sheets which would otherwise occur due to the shift.

When the operation is restarted in the same mode, the shift will not be effected at the time of the start of a copying operation and will be effected as stated above while a copying operation is under way.

Operations associated with the jogger fences 5 and 6 are as follows. As shown in FIGS. 1 and 9, on the turn-on of power supply and at the time of mode selection, the CPU checks the jogger home position sensor 14 and a tray paper sensor 205 to see their output states. If only the jogger home position sensor 14 has been turned on, nothing is performed. If both the sensor 14 and the sensor 205 have been turned on, a signal representative of the presence of paper sheets on the staple tray is sent to the copier body. If the sensor 14 is OFF and the sensor 205 have been turned on, the belt motor 22 is energized to drive the paper sheets out of the staple tray to the lower tray 53, then the jogger motor 11 is energized to move the jogger fences 5 and 6 toward their home position, and then the motor 11 is deenergized when the jogger home position sensor 11 turns off. When only the jogger home position sensor 14 has been turned off, the jogger motor 11 is driven to move the jogger fences 5 and 6 toward the home position and, on the turn-on of the sensor 14, the motor 11 is deenergized.

During, at the end of and at the restart of a copying operation, a paper size signal from the copier body arrives at the finisher after the start of copying. In response, the jogger motor 11 is energized to move each of the jogger fences 5 and 6 to a position which is a predetermined amount short of the widthwise paper size and causes it to wait there. As a predetermined time expires after the paper sheet has moved away from the lower paper discharge sensor 50, the jogger motor 11 is driven to move the jogger fences 5 and 6 away from their waiting positions in order to position the paper sheet. Thereafter, the jogger fences 5 and 6 are returned to their waiting positions. More specifically, the jogger motor 11 is rotated forward and then reversed once to several times to neatly arrange the paper sheet in the widthwise direction. Such a positioning action occurs every time a paper sheet arrives at the staple tray.

When the last paper sheet or copy has moved away from the copier discharge sensor 215, a staple signal is sent from the copier body to the finisher. In response, the last paper is discharged onto the staple tray, then positioned, and then restrained by the jogger fences 5 and 6 in the widthwise direction. On completion of the stapling operation, the jogger fences 5 and 6 are shifted to positions each being slightly spaced apart from the associated widthwise edge of the paper stack. As soon as the discharge belt 17 drives the stapled paper stack onto the tray 53, the jogger fences 5 and 6 are returned to the individual waiting positions. In this manner, the jogger fences 5 and 6 prevent the paper stack from being dislocated at the time of stapling and, in addition, serve as a guide when the stapled paper stack is driven out of the staple tray.

The above procedure is repeated until the desired number of volumes of copies have been produced. When the last stapled stack is driven out onto the tray 53, the jogger motor 11 is energized to return the jogger fences 5 and 6 to their home position. As soon as the jogger home position sensor 14 turns on, the motor 11 is deenergized.

At the time of the turn-on of power supply and when a stapler mode is selected, the CPU checks the output states of a one-rotation sensor 210, a staple sensor 211, an a stapler home sensor 212 which are shown in FIG. 9. Depending on the output states of such sensors, the CPU executes the following procedures.

When the tray paper sensor 205 has been turned on with the one-rotation sensor 210 having been turned off, a stapler error signal is transmitted to the copier body. When the tray paper sensor 205 has been turned off, the stapler S is determined to be out of its home position due to previously occurred jam processing, for example. Then, an idle stable request signal is sent to the copier body to cause the stapler to perform an idle stapling action once and then assume the home position.

If the staple sensor 211 has been turned off, a no staple signal is sent to the copier body. When the stapler home sensor 40 (FIG. 12) has been turned on, nothing is performed. If the stapler home sensor 40 has been turned off and the one-rotation sensor 210 has been turned on, the stepping motor 39 is energized to shift the stapler S to the home position; on the turn-on of the stapler home sensor 40, the motor 39 is deenergized. When the one-rotation sensor 210 has been turned off, the program waits by determining that a stapling action has failed or that jam processing has been performed previously. When the one-rotation sensor 210 is turned on by idle stapling or similar artificial processing, the motor 29 is energized to move the stapler S toward the home position. As soon as the stapler home sensor 40 turns on, the motor 39 is deenergized.

During, at the end of and at the restart of copying, when a paper size signal is received after the copier has started on a copying operation, the motor 39 is energized to move the stapler S by a predetermined amount to a particular position matching the paper size. After the last one of the set of paper sheets has moved away from the copier discharge sensor 215, a staple ON signal is sent from the copier to the finisher. In response, the last paper sheet is fed onto the staple tray and, as soon as the jogger fences 5 and 6 retain the paper stack at opposite widthwise edes of the latter, the staple motor 223 is energized to cause a stapling action to occur. The staple drive motor 223 is deenergized when the one-rotation sensor turns on. In a two-position staple mode, the stapler shift motor 39 is energized to move the stapler S over a predetermined distance, and then it is deenergized to cause a stapling action to occur at the second position. On the completion of the stapling operation, the motor 39 is energized to return the stapler S by the predetermined distance to the first position and then deenergized. Such a stapling operation is repeated until a desired number of volumes have been produced. When the last paper stack is stapled, the motor 39 is energized to return the stapler S toward the home position and, on the turn-on of the stapler home sensor 40, it is deenergized.

The discharge belt 17 is operated as follows.

On the turn-on of power supply and at the time of mode selection, the CPU checks the belt home sensor 48, tray paper sensor 205 and one-rotation sensor 210 to see their output states. If the belt home sensor 48 has been turned on and the tray paper sensor 205 has been turned off, no further processing occurs. If both the belt home sensor 48 and the tray paper sensor 205 have been turned off, the CPU determines that the discharge belt 17 has not been returned to the home position, energizes the belt motor 22 to move the belt 17, and deenergizes the motor 22 when the belt home sensor 48 turns on. If the belt home sensor 48 has been turned off and the tray paper sensor 205 has been turned on, the CPU determines that paper discharge has failed and energizes the motor 22 to move the belt 17. When the belt home sensor 48 turns on after the turn-off of the tray paper sensor 205, the motor 22 is deenergized. If the one-rotation sensor 210 has been turnd off, the CPU determines that the paper discharge has failed due to a stapling error, for example, and waits until the operator removes the paper stack existing on the staple tray. After the removal of the paper stack, the motor 22 is energized to move the belt 17 and, on the turn-on of the belt home sensor 48, it is deenergized.

During and at the end of copying, when the stapler S staples a paper stack which includes the last paper sheet or copy, the one-rotation sensor 210 turns on to indicate that the stapler S has stapled the paper stack without fail. Thereafter, the belt motor 22 is energized to cause the belt 17 to move the stapled paper stack onto the discharge tray 53. The motor 22 is deenergized when the belt home sensor 48 turns on. This kind of operation is repeated with each of a desired number of paper stacks.

Regarding the transport line associated with the upper tray 107, the transport motor 220 (FIG. 9) is energized in response to a finisher start signal which is fed from the copier body on the start of a copying operation. Specifically, the motor 220 is driven at a lower speed which is the same as the linear speed of the copier body. When a paper sheet driven out of the copier turns on the inlet sensor SN1, a timer is started to see if the paper sheet moves away from the inlet sensor SN1 within a predetermined period of time, i.e., if a jam occurs. When the trailing edge of the paper sheet moves away from the inlet sensor SN1, the sensor SN1 turns off so that the the motor 220 is switched to a higher speed to increase the paper transport rate. Further, a timer is started to see if the outlet sensor SN2 turns on within a predetermined period of time in response to the leading edge of the paper sheet, i.e., if a jam occurs. On the lapse of a predetermined period of time after the paper sheet has moved away from the inlet sensor SN1, the motor 220 is switched back to the lower speed to prepare for the entry of the next paper sheet. As the outlet sensor SN2 turns on by sensing the leading edge of the paper sheet, a timer is set to see if the paper sheet moves way from the sensor SN2 within a predetermined period of time.

The procedure described above is repeated thereafter. In the upper tray mode, after the arrival of a shift signal, a shift OK signal appears on the lapse of a predetermined period of time after the last one of a set of paper sheet has moved away from the outlet sensor SN2. Then, a timing for executing a shift is measured.

When the last paper sheet is driven out of the copier body, a finisher stop signal arrives at the finisher. In response, the motor 220 is deenergized when a predetermined period of time expires from the time when the last paper sheet has moved away from the outlet sensor SN2.

Regarding the transport line associated with the staple tray, the transport motor 220 is energized by the previously mentioned finisher start signal and rotated at the same speed as the linear speed of the copier body. When the inlet sensor SN1 turns on by sensing the leading edge of a paper sheet, the solenoid 230 and a lower transport motor 226 (FIG. 9) are energized. At the same time, a timer is set to see if the paper sheet moves away from the inlet sensor SN1 within a predetermined period of time, i.e., if a jam occurs. When the trailing edge of the paper sheet moves away from the inlet sensor SN1, the sensor SN1 turns off so that the motor 226 is switched to a higher speed to increase the paper transport rate. A timer is set to see if a lower outlet sensor 50 turns on within a predetermined period of time by sensing the leading edge of the paper sheet, i.e., if a jam occurs. As a predetermined period of time expires after the paper sheet has moved away from the inlet sensor SN1, the solenoid 230 is deenergied. When the outlet sensor 50 turns on in response to the paper sheet, a timer is set to see if the paper sheet moves away from the sensor 50 within a predetermined period of time. When a predetermined period of time expires after the paper sheet has moved away from the outlet sensor 50, the motor 226 is switched over to the lower speed.

After the above procedure has been repeated, a staple signal arrives at the finisher. In response, on the lapse of a predetermined period of time after the last paper sheet of a set of copies has moved away from the lower outlet sensor 50, a staple OK signal appears and a timing for a shift is measured. The copier body sends a finisher stop signal to the finisher when it discharges the last paper sheet, as stated earlier. In response, the motors 220 and 226 are deenergized on the lapse of a predetermined period of time after the last paper sheet has moved away from the outlet sensor 50.

Figure 16:
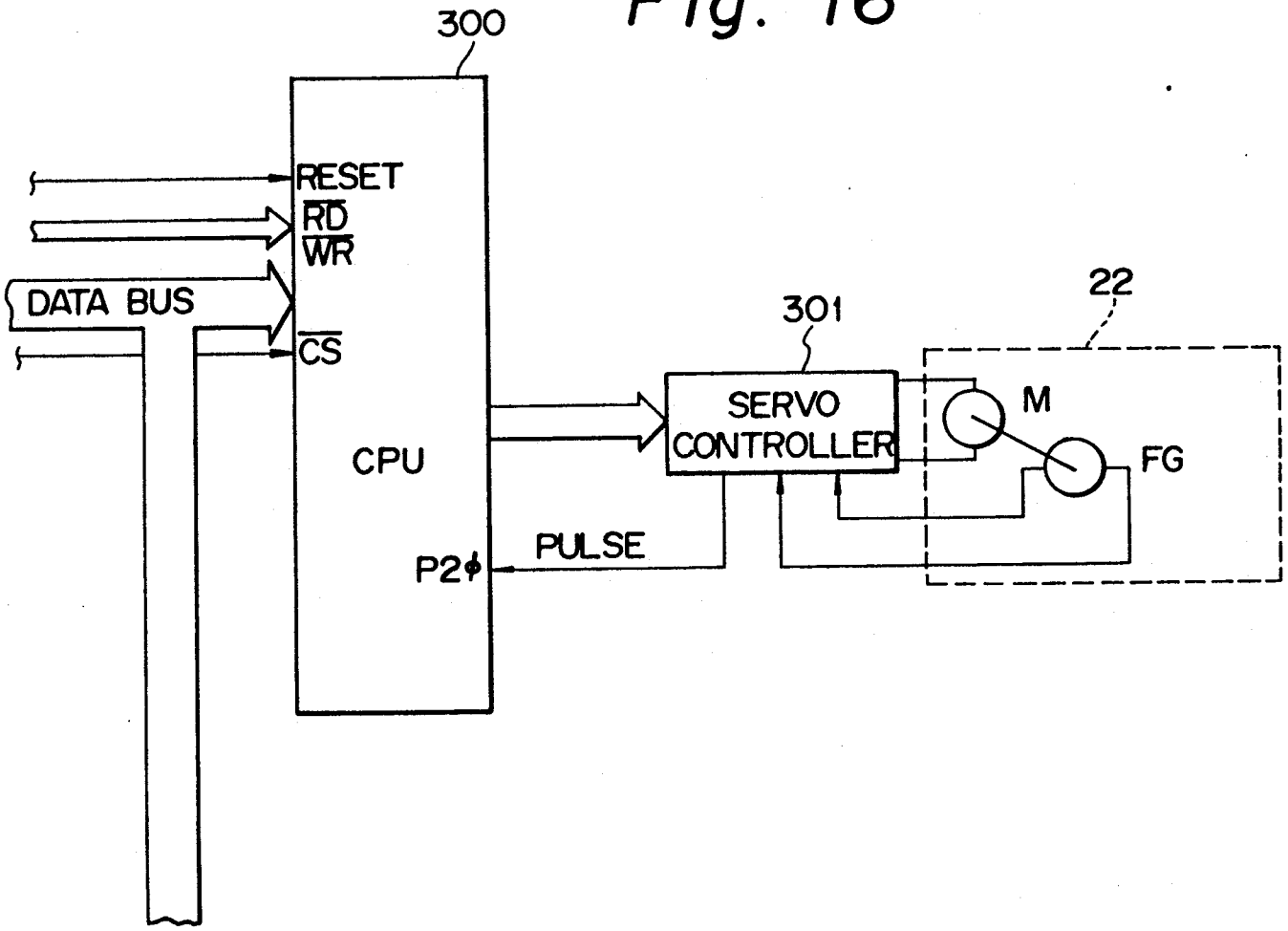
FIG. 16 is a schematic block diagram showing circuitry for detecting a jam on the basis of a motor lock condition.

Referring to FIG. 16, an essential arrangement in accordance with the present invention is shown in a schematic block diagram. As shown, a CPU 300 feeds a motor ON/OFF signal to a servo controller 301 so as to drive the belt motor 22. A tacho-generator (FG) is mounted on the shaft of the belt motor 22 to feed its output to the servo controller 301. The servo controller 301 delivers to a port P20 of the CPU 300 pulses which appear at constant intervals in synchronism with the rotation of the motor 22. Whether or not the motor 22 has been locked is determined on the basis of, for example, whether or not a pulse signal arrives at the port P20 while the CPU 300 is producing a motor ON signal. In practice, the motor 22 is determined to have been locked when a pulse does not arrive over a certain period of time while a motor ON signal is produced.

Figure 17:
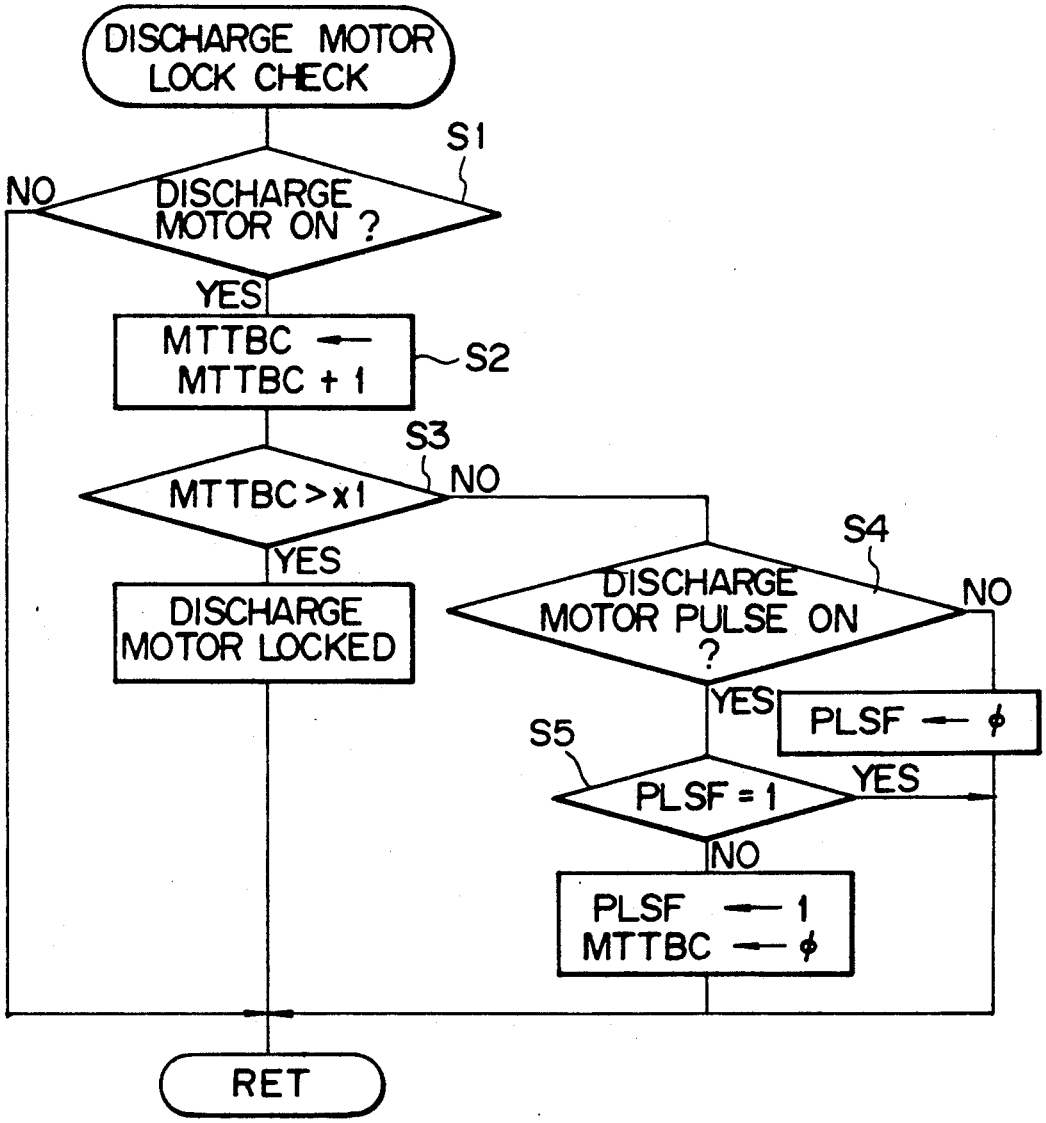
FIG. 17 is a flowchart demonstrating a sequence of steps for detecting the motor lock condition, i.e. a jam.

FIG. 17 is a flowchart demonstrating a procedure for detecting a motor lock condition in the event of paper discharge. The procedure begins with a step S1 for determining whether or not the motor associated with the discharge belt 17 has been energized. If the answer of the step S1 is YES, a counter MTTBC responsive to the motor lock condition is incremented by 1 (one) at a time (step S2). Whether or not the content of the counter is greater than a predetermined value is determined in a step S3. If the answer of the step S3 is YES, it is determined that the motor has been locked. If the answer of the step S3 is NO, pulses which are expected to be produced by the servo controller 301 in response to the rotation of the motor are checked (step S4). If the answer of the step S4 is YES, whether or not a flag PLSF is (logical) ONE is determined (step S5). If the answer of the step S5 is YES, the program returns; if otherwise, the flag PLSF is set to ONE while the counter MTTBC is cleared to "0". The counter MTTBC is cleared to "0" every time a normal pulse arrives and, therefore, does not exceed a predetermined value so far as the operation of the motor is normal. However, once the motor is locked, the counter MTTBC will not be cleared because the pulse signal remains in an ON state or an OFF state. In this subroutine, a motor lock condition is detected when the counter MTTBC which is incremented by 1 at a time exceeds a predetermined value. By such a motor lock detecting procedure, it is possible to detect a stapling error such as the catching of a staple. This, combined with the detection of a stapler home position, is successful in surely detecting stapling errors.

In summary, the present invention achieves various advantages as enumerated below.

(1) Efficient and easy manipulations are promoted because the operator can reach a discharged paper stack without bending over. An extra paper discharge path is eliminated to miniaturize an image forming apparatus.

(2) A paper stack can be stapled automatically at an adequate position or positions thereof.

(3) A stapled paper stack is discharged stably, especially without being loosened at the discharge side. A number of paper sheets bound together can be directly driven out of a stapling device onto a tray.

(4) A stapling error is detected easily and accurately. This promotes prompt processing for coping with a stapling error.

(5) Paper sheets are neatly positioned and bound at a paper transport position. Hence, the period of time necessary for positioning and binding paper sheets is reduced to enhance efficient stapling operations.

(6) Jogger fences regulate incoming paper sheets at any desired position, so that the paper sheets can be stapled at any suitable position or positions thereof.

(7) A jam of a stapled paper stack is detected readily and surely to promote rapid processing.

(8) Paper sheets are surely fed into the stapling device by a simple construction, even if they are curled.

(9) Paper sheets driven out of an image forming apparatus after a stapling function has failed are protected while allowing the other processing to be effected efficiently.

Various modifications will become possible for those skilled in the art after receiving the teachings of the present disclosure without departing from the scope thereof.

What is claimed is:

1. A finisher for stapling sheets sequentially driven out of an apparatus, comprising:

a frame;

a first tray disposed in an upper portion of said frame;

stapling means located in a lower portion of said frame;

an inlet for receiving a paper sheet driven out of the apparatus;

a first path extending from said inlet to said first tray;

a second path extending from said inlet to said stapling means;

a second tray disposed below said first tray;

discharging means directly connected to said second tray for discharging a stack of paper sheets having been stapled by said stapling means onto said second tray;

said stapling means comprising a paper receiver, a stapling device for stapling paper sheets loaded on said paper receiver and jogger fences for positioning sheets loaded on said paper receiver; and wherein said discharging means includes a discharge belt directly connecting said stapling means and said second tray to each other, and holding means protruding from said discharge belt for holding a stapled stack of sheets at a side where said sheets are stapled.

2. A finisher as claimed in claim 1, wherein said jogger fences function as guide means when said discharging means dicharges the stapled stack of sheets.

3. A finisher as claimed in claim 1, wherein said discharge belt extends aslant in a nearly vertical direction.

4. A finisher as claimed in claim 1, wherein said discharging means further comprises rigidity providing means for providing a stapled stack of sheet with rigidity by deforming said stack in a wave-like configuration in a direction perpendicular to an intended direction of sheet transport.

5. A finisher as claimed in claim 4, wherein said rigidity providing means comprises pressing means for pressing a stapled stack of sheets in different positions and in a direction perpendicular to a surface of said stapled stack.

6. A finisher as claimed in claim 1, further comprising staple error detecting means associated with said discharging means and said stapling means for detecting a stapling error.

7. A finisher as claimed in claim 6, further comprising path control means for replacing said first and second paths with a path to a second tray in response to an output of said staple error detecting means representative of a stapling error.

8. A finisher as claimed in claim 1, further comprising jam detecting means associated with said discharging means for detecting an error in the discharge of sheets.

* * * * *